US008937518B2

(12) United States Patent
Suzuki et al.

(10) Patent No.: US 8,937,518 B2
(45) Date of Patent: Jan. 20, 2015

(54) ELECTROMAGNETIC SWITCH

(75) Inventors: Kenji Suzuki, Kounosu (JP); Yasuhiro Naka, Kounosu (JP); Kouetsu Takaya, Kounosu (JP); Yuji Shiba, Kounosu (JP); Yuichi Yamamoto, Kounosu (JP)

(73) Assignee: Fuji Electric Co., Ltd., Kawasaki-shi, Kanagawa (JP)

( * ) Notice: Subject to any disclaimer, the term of this patent is extended or adjusted under 35 U.S.C. 154(b) by 0 days.

(21) Appl. No.: 13/696,929

(22) PCT Filed: Jun. 14, 2011

(86) PCT No.: PCT/JP2011/003381
§ 371 (c)(1),
(2), (4) Date: Dec. 21, 2012

(87) PCT Pub. No.: WO2012/029218
PCT Pub. Date: Mar. 8, 2012

(65) Prior Publication Data

US 2014/0176268 A1 Jun. 26, 2014

(30) Foreign Application Priority Data

Aug. 31, 2010 (JP) ..... 2010-194463

(51) Int. Cl.
*H01H 67/02* (2006.01)
*H01H 50/54* (2006.01)
(Continued)

(52) U.S. Cl.
CPC ..... *H01H 50/546* (2013.01); *H01H 9/443* (2013.01); *H01H 50/30* (2013.01)
USPC ..... 335/126; 335/131

(58) Field of Classification Search
USPC ..... 335/126
See application file for complete search history.

(56) References Cited

U.S. PATENT DOCUMENTS 4,575,598 A * 3/1986 Yamagata et al. ..... 218/150
5,073,764 A * 12/1991 Takahashi et al. ..... 335/16
(Continued)

FOREIGN PATENT DOCUMENTS

CN 1327604 A 12/2001
CN 1701403 A 11/2005
(Continued)

OTHER PUBLICATIONS

PCT, "International Search Report for PCT/JP2011/003381", Jul. 12, 2011.
(Continued)

*Primary Examiner* — Shawki S Ismail
*Assistant Examiner* — Lisa Homza
(74) *Attorney, Agent, or Firm* — Manabu Kanesaka

(57) ABSTRACT

An electromagnetic switch has a contact device having a pair of fixed contacts fixed inside an arc extinguishing chamber housing and a movable contact disposed to contact with and separate from the fixed contacts; and an electromagnetic device having a movable plunger moving between an opened position wherein the movable contact separates from the fixed contacts and a closed position wherein the movable contact contacts with the fixed contacts and pressed down. The arc extinguishing chamber housing is provided with permanent magnets to extinguish an arc generated at an opening time when the movable contact separates from the fixed contacts from a state in the closed position wherein the movable contact is contacting with the fixed contacts. In a state wherein the movable plunger is in the opened position, a magnetic circuit is formed starting from the permanent magnets and returning to the permanent magnets through the movable plunger.

5 Claims, 2 Drawing Sheets

(51) Int. Cl.
*H01H 9/44* (2006.01)
*H01H 50/30* (2006.01)

(56) References Cited

U.S. PATENT DOCUMENTS

| | | | | |
|---|---|---|---|---|
| 6,373,014 | B1 * | 4/2002 | Mitsuhashi et al. | 218/22 |
| 6,700,466 | B1 * | 3/2004 | Yamamoto et al. | 335/132 |
| 7,157,996 | B2 | 1/2007 | Enomoto et al. | |
| 7,692,522 | B2 | 4/2010 | Hartinger et al. | |
| 2006/0050466 | A1 | 3/2006 | Enomoto et al. | |
| 2009/0322453 | A1 * | 12/2009 | Kawaguchi et al. | 335/81 |
| 2012/0326815 | A1 * | 12/2012 | Suzuki et al. | 335/185 |

FOREIGN PATENT DOCUMENTS

| | | | |
|---|---|---|---|
| CN | 201562631 | U | 8/2010 |
| JP | 404341721 | * | 11/1992 |
| JP | 2010-10057 | A | 1/2010 |
| JP | 2010-10058 | A | 1/2010 |
| JP | 2010-118206 | A | 5/2010 |
| WO | 2006/069970 | A1 | 7/2006 |

OTHER PUBLICATIONS

Europe Patent Office, "Search Report for EP11821243.0," Apr. 22, 2014.

China Patent Office, "Office Action for CN 201180027673.0," Sep. 23, 2014.

* cited by examiner

ELECTROMAGNETIC SWITCH

RELATED APPLICATIONS

The present application is National Phase of International Application No. PCT/JP2011/003381 filed Jun. 14, 2011, and claims priority from Japanese Application No. 2010-194463, filed Aug. 31, 2010.

TECHNICAL FIELD

The present invention relates to an electromagnetic switch including a contact device having fixed contacts and a movable contact inserted in a current path, and an electromagnet that drives the movable contact.

BACKGROUND ART

There are proposed various mechanisms for an electromagnetic switch, such as an electromagnetic relay or electromagnetic contactor, that carry out an opening and closing of a current path, and extinguish an arc generated at an opening time when a movable contact separates from a fixed contact to cut off the current, thus obtaining an opened state from a closed state of a contact mechanism wherein the fixed contact and movable contact are contacting.

For example, there is proposed an electromagnetic relay having a configuration including a pair of fixed contacts disposed with a predetermined distance therebetween, a movable contact disposed to contact with and separate from the pair of fixed contacts, and an electromagnetic block having a movable iron core that drives the movable contact. U-form magnetic holding members are disposed on the outer side of a sealing housing facing either side surface side of positions in which the fixed contacts faces the movable contact, and two sets of pairs of permanent magnets are disposed on the inner side of the magnetic holding members for expediting the extinguishment of arc by drawing out the arc using magnetic force (for example, refer to Patent Document 1).

RELATED ART DOCUMENTS

Patent Documents

Patent Document 1: JP-A-2010-10057

OUTLINE OF THE INVENTION

Problems to be Solved by the Invention

In the heretofore known example described in Patent Document 1, by disposing a pair of permanent magnets to face in each position in which the pair of fixed contacts and movable contact are facing each other, the extinguishing of an arc generated at an opening time when the movable contact separates from the pair of fixed contacts is expedited by drawing the arc using the magnetic force of the permanent magnets.

However, in a case in which a movable contact is disposed to contact with and separate from a pair of fixed contacts separated by a predetermined distance, as in the heretofore known example described in Patent Document 1, there is a demand for improvement in vibration and impact resistance performance at a contact mechanism opening time when the movable contact is separated from the pair of fixed contacts. Heretofore, in order to improve the vibration and impact resistance performance, the urging force of a return coil spring provided in a movable iron core that holds the movable contact has been increased, thus suppressing the vibration of the movable iron core.

However, although it is possible to improve the vibration and impact resistance performance when increasing the urging force of the return coil spring, it is necessary that the movable iron core can move against the urging force of the return coil spring at a contact mechanism closing time, and thus necessary to increase electromagnetic suction force generated in an electromagnetic block, and there is an unsolved problem in that this leads to an increase in size of the electromagnetic block, and an increase in power consumption for exciting an exciting coil.

Therefore, the invention is conceived focusing on the unsolved problem of the heretofore known example, and has an object of providing an electromagnetic switch wherein it is possible to improve vibration and impact resistance performance without increasing return urging force.

Means for Solving the Problems

In order to achieve the heretofore described object, a first aspect of an electromagnetic switch according to the invention includes a contact device having a pair of fixed contacts maintaining a predetermined interval and fixed inside an arc extinguishing chamber housing, and a movable contact disposed to contact with and separate from the pair of fixed contacts; and an electromagnetic device having a movable plunger moving between an opened position wherein the movable contact separates from the fixed contacts and a closed position wherein the movable contact contacts with the fixed contacts and further depressed. Then, permanent magnets, which extinguish an arc generated at an opening time when the movable contact separates from the fixed contacts from a state in the closed position in which the movable contact is contacting with the fixed contacts, are provided on the arc extinguishing chamber housing. In a state in which the movable plunger is in the opened position, a magnetic circuit is formed from the permanent magnets and returning to the permanent magnets through the movable plunger.

According to this configuration, as the extinguishing of an arc generated at a contact mechanism opening time is carried out by the permanent magnets, and a magnetic circuit from the permanent magnets, returning to the permanent magnets via the movable plunger, is formed when the contact mechanism is opened, the movable plunger is suctioned by the magnetic force of the magnetic circuit and it is possible to improve vibration and impact resistance performance without increasing the urging force of a return spring.

Also, a second aspect of the electromagnetic switch according to the invention is such that the permanent magnets are disposed facing the movable contact in positions perpendicular to the longitudinal direction of the movable contact on the outer side of opposite side walls of the arc extinguishing chamber housing.

According to this configuration, as the permanent magnets are disposed in positions facing the movable contact, it is possible to effectively draw out and extinguish an arc generated at an opening time when the movable contact separates from the pair of fixed contacts.

Also, a third aspect of the electromagnetic switch according to the invention is such that the magnetic circuit includes first magnetic yokes disposed between the pair of fixed contacts on the inner surface side of the arc extinguishing chamber housing facing the permanent magnets and contacting with the movable plunger in the opened position, and second magnetic yokes facing a section of the movable plunger on the side opposite to the section contacting with the first magnetic yoke and contacting with the back surface sides of the permanent magnets.

According to this configuration, it is possible to configure a magnetic circuit passing from the permanent magnets via the first magnetic yokes and movable plunger, and returning to the permanent magnets from the second magnetic yokes, at a contact mechanism opening time, and thus possible to improve the vibration and impact resistance performance of the movable plunger by generating, in the first magnetic yokes, an electromagnetic suction force that suctions the movable plunger. Herein, as a sufficient gap is provided between the movable plunger and first magnetic yokes when the arc is drawn out and extinguished, there is no effect on the function whereby an arc generated at an opening time is extinguished by the permanent magnets.

Advantage of the Invention

According to the invention, as a magnetic circuit from the permanent magnets, returning to the permanent magnets via the movable plunger, is formed in a state in which the movable plunger is in the opened position, an advantage is obtained in that an electromagnetic suction force that suppresses vibration of the movable plunger is generated acting on the movable plunger, and it is thus possible to improve vibration and impact resistance performance without increasing return urging force.

MODE FOR CARRYING OUT THE INVENTION

Hereafter, a description will be given, based on the drawings, of an embodiment of the invention.

Figure 1:
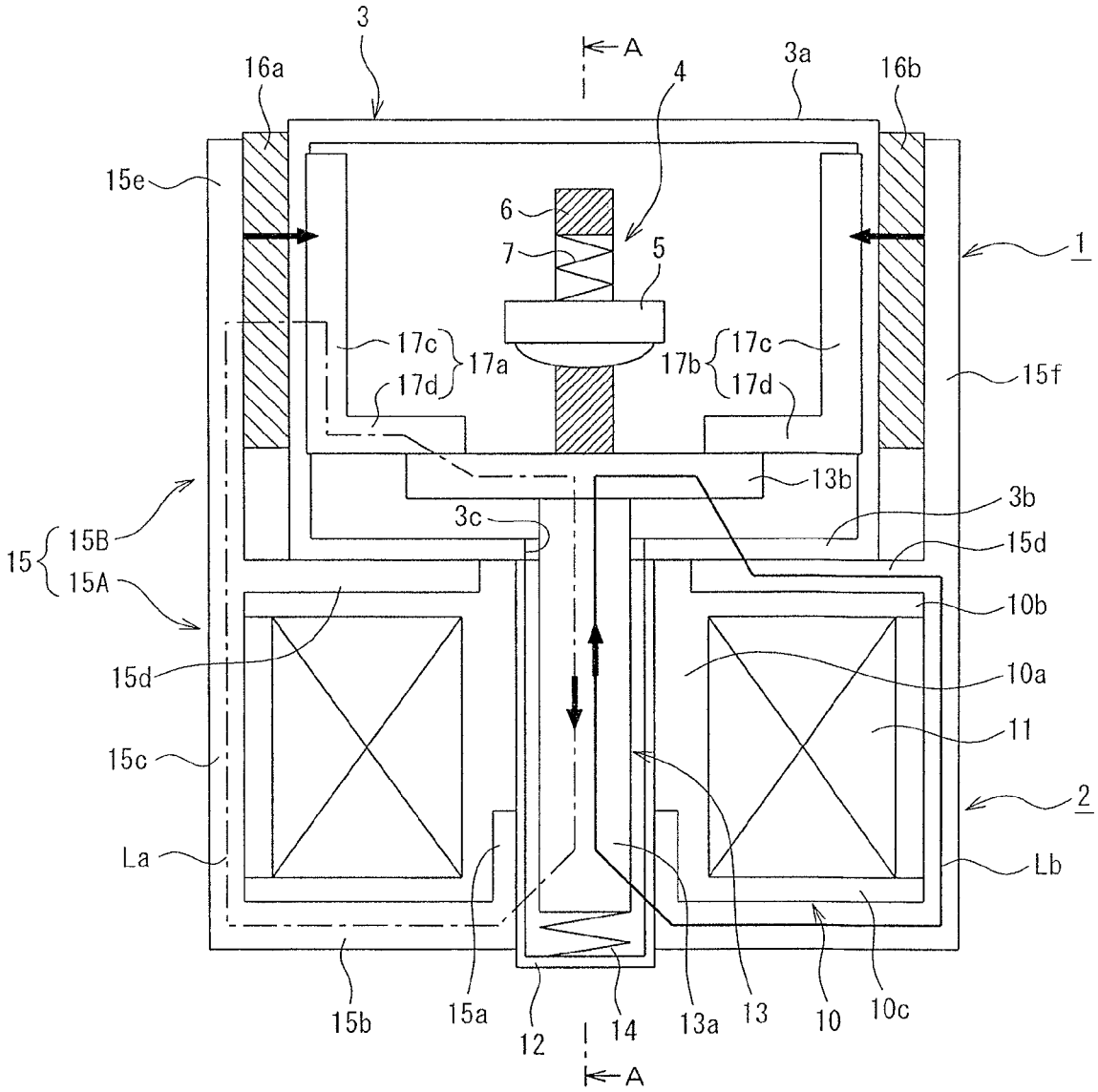
FIG. 1 is a sectional view showing one embodiment of a case in which the invention is applied to an electromagnetic contactor.

FIG. 1 is a sectional view showing one example of a case in which a contact device of the invention is applied to an electromagnetic contactor acting as an electromagnetic switch. In FIG. 1, numeral 1 is a contact device, and an electromagnetic device 2 is provided on the lower surface side of the contact device 1.

The contact device 1 has an arc extinguishing chamber housing 3, which is, for example, an airtight housing wherein an insulation process has been carried out on a non-magnetic body and on an insulator or inner wall, and a contact mechanism 4 is provided inside the arc extinguishing chamber housing 3. The arc extinguishing chamber housing 3 is configured of a bottomed tubular body 3*a*, whose lower end surface is opened, and a bottom plate portion 3*b* that closes off the lower end surface of the bottomed tubular body 3*a*. An insertion hole 3*c*, through which is inserted a shaft portion 13*a* of a movable plunger 13, to be described hereafter, is formed in a central portion of the bottom plate portion 3*b*.

The contact mechanism 4 is configured of fixed contacts 4*a* and 4*b* and a movable contact 5. The fixed contacts 4*a* and 4*b* are fixed and supported, with inner side ends thereof separated by a predetermined distance and outer side ends thereof protruding to the exterior of the arc extinguishing chamber housing 3, in opposing wall surfaces of the bottomed tubular body 3*a* of the arc extinguishing chamber housing 3, as shown in FIG. 2.

Figure 2:
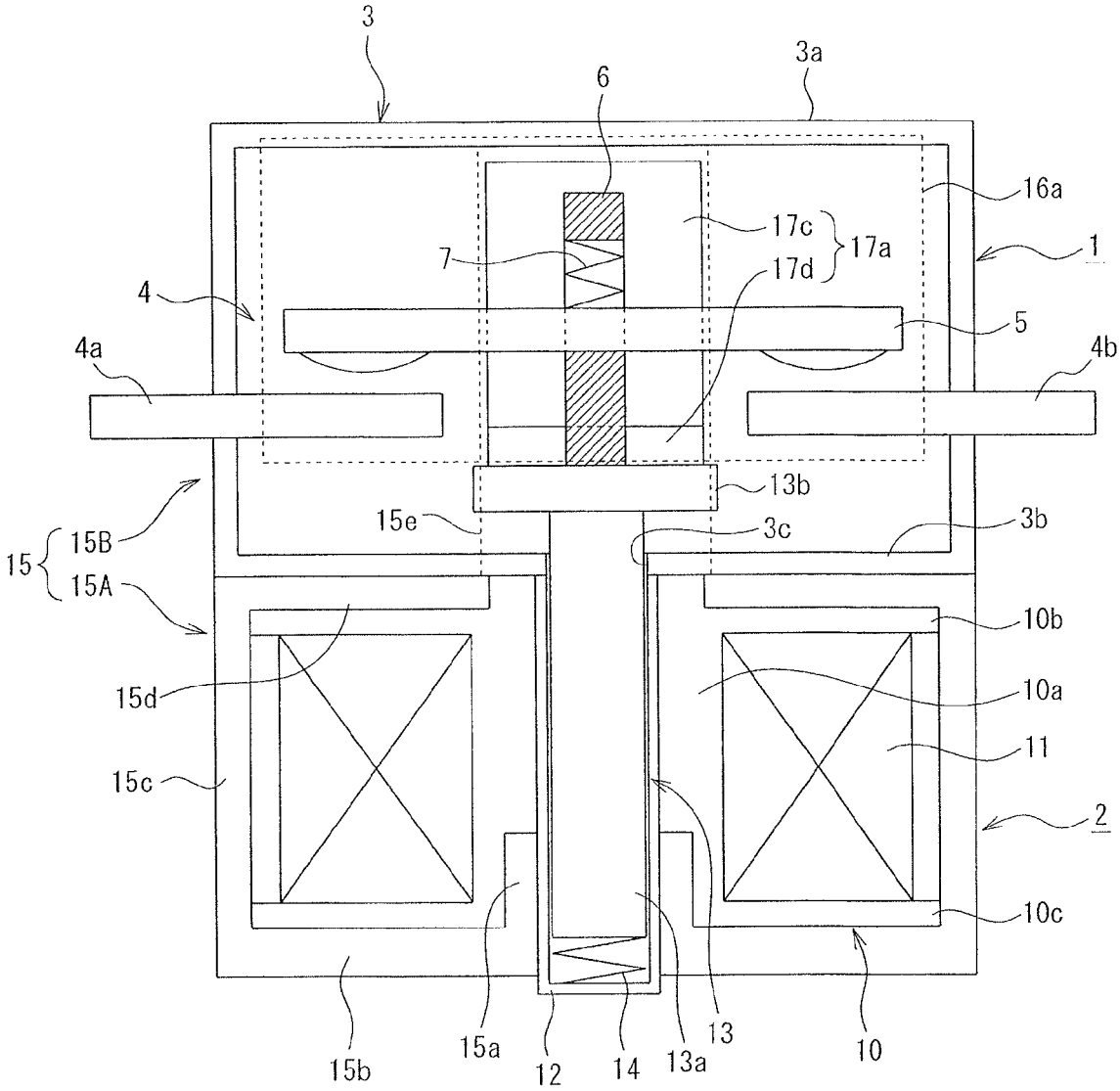
FIG. 2 is a sectional view along a line A-A of FIG. 1.

Also, as shown in FIG. 1 and FIG. 2, the movable contact 5 is formed in a flat plate form, and is disposed facing the fixed contacts 4*a* and 4*b* across a predetermined distance on the upper end side thereof, so that it can contact with and separate from the fixed contacts 4*a* and 4*b*. The movable contact 5 is mounted, urged downward by a contact spring 7, in a contact holder 6 fixed and supported by the movable plunger 13, to be described hereafter.

Also, the electromagnetic device 2 is provided on the lower surface side of the arc extinguishing chamber housing 3. The electromagnetic device 2 includes a coil bobbin 10 configured of a cylindrical portion 10*a*, whose axial direction is a vertical direction, and flange portions 10*b* and 10*c* protruding outward from either end of the cylindrical portion 10*a*. An exciting coil 11 is wound inside a cylindrical space bounded by the cylindrical portion 10*a* and flange portions 10*b* and 10*c* of the coil bobbin 10.

Also, a bottomed tubular body 12, whose top end is opened, is fitted into the inner peripheral surface of the cylindrical portion 10*a* of the coil bobbin 10, and the movable plunger 13, made of a magnetic body, is guided so as to be freely movable vertically inside the bottomed tubular body 12.

The movable plunger 13 is configured in a T-form of a shaft portion 13*a*, inserted into the bottomed tubular body 12, and a flat plate portion 13*b*, extending in left and right directions, fixed to an end portion of the shaft portion 13*a* protruding into the arc extinguishing chamber housing 3. The contact holder 6, which holds the movable contact 5 in a central portion of the upper surface, is fixed and supported in the flat plate portion 13*b* of the movable plunger 13.

Also, a return spring 14 is inserted between the lower end surface of the shaft portion 13*a* of the movable plunger 13 and the bottom surface of the bottomed tubular body 12, and the movable plunger 13 is urged upward by the return spring 14. Then, an upper position, that is, an opened position, of the movable plunger 13 is regulated by the flat plate portion 13*b* contacting with a first magnetic yoke, to be described hereafter.

Also, a second magnetic yoke 15 is disposed on the outer peripheral side of the coil bobbin 10. The second magnetic yoke 15 includes a suction yoke portion 15A, which generates an electromagnetic suction force that suctions the movable plunger 13, against the force of the return spring 14, and an extension yoke portion 15B which, coupled to the suction yoke portion 15A, extends to the back surface of a permanent magnet, to be described hereafter.

The suction yoke portion 15A includes an inner tubular portion 15*a* facing the lower end side of the shaft portion 13*a* of the movable plunger 13 across the bottomed tubular body 12, a bottom plate portion 15*b* that covers the bottom surface of the coil bobbin 10 in conjunction with the lower end surface of the inner tubular portion 15*a*, an outer tubular portion 15*c* that, extending upward from the outer peripheral edge of the bottom plate portion 15*b*, covers the outer peripheral surface of the coil bobbin 10, and an upper plate portion 15*d* that, extending inward from the upper end of the outer tubular portion 15*c*, covers the upper surface if the coil bobbin 10.

Also, the extension yoke portion 15B, as shown in FIG. 1, is configured of extension plate portions 15*e* and 15*f*, which extend from opposing outer peripheral edges of the upper plate portion 15*d* of the suction yoke portion 15A to the outer surfaces of permanent magnets 16*a* and 16*b*, to be described hereafter.

Meanwhile, the permanent magnets 16*a* and 16*b*, of a flattened cuboid form having a width virtually equivalent to the length in the longitudinal direction of the movable contact 5, are fixed using an adhesive, or the like, in positions facing the movable contact 5 on either side of the outer peripheral surface of the arc extinguishing chamber housing 3 of the contact device 1. Each of the permanent magnets 16*a* and 16*b* is magnetized in such away that the inner surface side contacting with the arc extinguishing chamber housing 3 is the north pole, while the outer surface side is the south pole.

Also, first magnetic yokes 17*a* and 17*b* are disposed in opposed positions between the pair of fixed contacts 4*a* and 4*b* on the inner peripheral surface of the arc extinguishing chamber housing 3 facing the permanent magnets 16*a* and 16*b*.

Each of the first magnetic yokes 17*a* and 17*b* is configured in a sectional L-form of a vertical plate portion 17*c*, fixed to the inner wall of the arc extinguishing chamber housing 3, and a horizontal plate portion 17*d* extending inward from the lower end of the vertical plate portion 17*c*. Herein, the horizontal plate portion 17*d* is extended to a position such that the inner end thereof faces the fixed contacts 4*a* and 4*b* while maintaining a predetermined interval, and is contacting with the upper surface of the previously described flat plate portion 13*b* of the movable plunger 13. Furthermore, the lower surface of the horizontal plate portion 17*d* is set so that, in a state in which the flat plate portion 13*b* of the movable plunger 13 is in the opened position wherein it is contacting, the upper surface of the flat plate portion 13*b* is in a position separated by a predetermined distance from the fixed contacts 4*a* and 4*b*.

Next, a description will be given of an operation of the embodiment.

Now, when the exciting coil of the electromagnetic device 2 is in a non-conductive state in which no current is supplied, no magnetic flux flows to the suction yoke portion 15A of the second magnetic yoke 15, and a state is such that no electromagnetic suction force suctioning the movable plunger 13 is generated.

Because of this, the movable plunger 13 is urged upward by the return spring 14, and the upper end of the flat plate portion 13*b* is in the opened position wherein it is contacting with the lower surface of the horizontal plate portions 17*d* of the first magnetic yokes 17*a* and 17*b*.

In the state in which the movable plunger 13 is in the opened position, the movable contact 5 is separated from the fixed contacts 4*a* and 4*b* by in the region of, for example, 2 mm upward, as shown in FIG. 2, the contact device 1 is in an opened state, and power supplied to the one fixed contact 4*a* is not supplied to the fixed contact 4*b*, resulting in a power shutoff state.

As the flat plate portion 13*b* of the movable plunger 13 is contacting with the lower surface of the horizontal plate portions 17*d* of the first magnetic yokes 17*a* and 17*b* when the contact mechanism 4 is in the opened state, a magnetic path La indicated by the dashed dotted line in FIG. 1 is formed. That is, there is formed a magnetic circuit wherein a magnetic flux output from the permanent magnet 16*a* returns to the permanent magnet 16*a* via the first magnetic yoke 17*a*, the movable plunger 13, and the inner tubular portion 15*a*, bottom plate portion 15*b*, outer tubular portion 15*c*, and extension plate portion 15*e* of the second magnetic yoke 15.

In the same way, there is formed a magnetic circuit wherein a magnetic flux output from the permanent magnet 16*b* returns to the permanent magnet 16*b* via the first magnetic yoke 17*b*, the movable plunger 13, and the inner tubular portion 15*a*, bottom plate portion 15*b*, outer tubular portion 15*c*, and extension plate portion 15*f* of the second magnetic yoke 15.

Because of this, the flat plate portion 13*b* of the movable plunger 13 is suctioned by the first magnetic yokes 17*a* and 17*b*. Consequently, the movable plunger 13 is pressed against the horizontal plate portions 17*d* of the first magnetic yokes 17*a* and 17*b* by two forces—the suction force of the first magnetic yokes 17*a* and 17*b* and the urging force of the return spring 14. Because of this, as the movable plunger 13 does not separate from the first magnetic yokes 17*a* and 17*b* even in the event that vibration or an impact force is introduced into the electromagnetic contactor from the exterior, it is possible to improve vibration and impact resistance performance without increasing the urging force of the return spring 14.

When energizing the exciting coil 11 with the contact device 1 in the opened state, there is formed a magnetic circuit Lb from the flat plate portion 13*b* of the movable plunger 13, returning to the shaft portion 13*a* of the movable plunger 13 via the upper plate portion 15*d*, outer tubular portion 15*c*, bottom plate portion 15*b*, and inner tubular portion 15*a* of the suction yoke portion 15A of the second magnetic yoke, and a magnetic flux flows through the movable plunger 13 in a direction reverse of that in the magnetic circuit La. Because of this, the flat plate portion 13*b* of the movable plunger 13 is suctioned to the upper plate portion 15*d* in the suction yoke portion 15A of the second magnetic yoke 15. As a result of this, the movable plunger 13 descends against the force of the return spring 14, in accordance with which the movable contact 5 held in the contact holder 6 descends, and is contacting with the fixed contacts 4*a* and 4*b* at a predetermined contact pressure applied by the contact spring 7. Because of this, the space between the fixed contacts 4*a* and 4*b* is brought into a state of continuity by the movable contact 5, and the contact device 1 is in a closed state.

When stopping the energizing of the exciting coil 11 with the contact device 1 in the closed state, the magnetic flux ceases to flow through the magnetic circuit in the suction yoke portion 15A of the second magnetic yoke 15 of the electromagnetic device 2, and the electromagnetic suction force exerted by the upper plate portion 15*d* of the second magnetic yoke 15 is extinguished. Because of this, the movable plunger 13 is returned by the urging force of the return spring 14 to the opened position wherein the movable plunger 13 is contacting with the first magnetic yokes 17*a* and 17*b*. Because of this, the movable contact 5 moves upward, separating from the fixed contacts 4*a* and 4*b*, and the contact device 1 returns to the opened position.

At an opening time when the movable contact 5 separates from the fixed contacts 4*a* and 4*b*, an arc is generated in the contact space between the movable contact 5 and fixed contacts 4*a* and 4*b*, but as the permanent magnets 16*a* and 16*b* are disposed facing each other in positions facing the arc, the arc is drawn out and extinguished by the magnetic force of the permanent magnets 16*a* and 16*b*.

In this way, according to the embodiment, utilizing the permanent magnets 16*a* and 16*b* that extinguish an arc generated in the contact mechanism 4 of the contact device 1, there is formed, in a state in which the movable plunger 13 is in the opened position, a magnetic circuit wherein magnetic fluxes output from the permanent magnets 16*a* and 16*b* return to the permanent magnets 16*a* and 16*b* via the first magnetic yokes 17*a* and 17*b*, the movable plunger 13, and the suction yoke portion 15A and extension yoke portion 15B of the second magnetic yoke 15. Because of this, it is possible to cause an electromagnetic suction force that suctions the flat plate portion 13*b* of the movable plunger 13 to be generated in the first magnetic yokes 17*a* and 17*b*. Consequently, in conjunction with the urging force of the return spring 14, it is possible to cause the first magnetic yokes 17*a* and 17*b* to reliably hold the movable plunger 13, and thus possible to improve vibration and impact resistance performance without increasing the urging force of the return spring 14. Because of this, it is possible to improve vibration and impact resistance performance without the size of the configuration of the electromagnetic device 2 increasing, and without power consumption increasing.

Moreover, as the first magnetic yokes 17*a* and 17*b* are disposed between the fixed contacts 4*a* and 4*b*, there is no effect on the function whereby an arc generated between the movable contact 5 and fixed contacts 4*a* and 4*b* at an opening time is extinguished by the permanent magnets 16*a* and 16*b*, and it is possible to improve vibration and impact resistance performance while fulfilling a reliable arc extinguishing function.

In the embodiment, a description has been given of a case in which the permanent magnets 16*a* and 16*b* are disposed on the outer wall of the arc extinguishing chamber housing 3 but, not being limited to this, a pocket portion in which the permanent magnets 16*a* and 16*b* are housed may be formed on the inner wall side of the arc extinguishing chamber housing 3. In this case, it is sufficient that the first magnetic yokes 17*a* and 17*b* are disposed on the inner side of the pocket portion.

Also, in the embodiment, a description has been given of a case in which the permanent magnets 16*a* and 16*b* are formed in one flattened cuboid but, not being limited to this, they may also be formed divided into two portions or more.

Furthermore, in the embodiment, a description has been given of a case in which the invention is applied to an electromagnetic contactor but, not being limited to this, it is also possible to apply the invention to another electromagnetic switch, such as an electromagnetic relay.

Industrial Applicability

The invention provides an electromagnetic switch wherein there is formed a magnetic circuit from a permanent magnet, returning to the permanent magnet via a movable plunger, an electromagnetic suction force that suppresses vibration of the movable plunger is generated acting on the movable plunger, and it is possible to improve vibration and impact resistance performance without increasing return urging force.

DESCRIPTION OF REFERENCE NUMERALS AND SIGNS

1 . . . Contact device, 2 . . . Electromagnetic device, 3 . . . Arc extinguishing chamber housing, 3*a* . . . Bottomed tubular body, 3*b* . . . Bottom plate portion, 4 . . . Contact mechanism, 4*a*, 4*b* . . . Fixed contact, 5 . . . Movable contact, 6 . . . Contact holder, 7 . . . Contact spring, 10 . . . Coil bobbin, 11 . . . Exciting coil, 12 . . . Bottomed tubular body, 13 . . . Movable plunger, 13*a* . . . Shaft portion, 13*b* . . . Flat plate portion, 14 . . . Return spring, 15 . . . Second magnetic yoke, 15A . . . Suction yoke portion, 15B . . . Extension yoke portion, 15*a* . . . Inner tubular portion, 15*b* . . . Bottom plate portion, 15*c* . . . Outer tubular portion, 15*d* . . . Upper plate portion, 15*e*, 15*f* . . . Extension plate portion, 16*a*, 16*b* . . . Permanent magnet, 17*a*, 17*b* . . . First magnetic yoke

What is claimed is:

1. An electromagnetic switch, comprising:

a contact device having a pair of fixed contacts maintaining a predetermined interval therebetween and fixed inside an arc extinguishing chamber housing, and a movable contact disposed to be capable of contacting with and separating from the pair of fixed contacts; and an electromagnetic device having a movable plunger moving between an opened position wherein the movable contact separates from the fixed contacts and a closed position wherein the movable contact contacts with the fixed contacts to press down, wherein the arc extinguishing chamber housing is provided with permanent magnets to extinguish an arc generated at an opening time when the movable contact separates from the fixed contacts from a state in the closed position in which the movable contact contacts with the fixed contacts, the magnetic circuit comprises first magnetic yokes disposed between the pair of fixed contacts on an inner surface side of the arc extinguishing chamber housing facing the permanent magnets and located on an upper side of the movable contact, the first magnetic yokes contacting with the movable plunger in the opened position, and second magnetic yokes located at a side opposite to the movable plunger relative to the first magnetic yoke, and contacting with back surfaces of the permanent magnets, and in a state in which the movable plunger is in the opened position, a magnetic circuit is formed starting from the permanent magnets and returning to the permanent magnets through the first and second magnetic yokes and the movable plunger.

2. An electromagnetic switch according to claim 1, wherein the permanent magnets are disposed to face the movable contact opposite side walls of the arc extinguishing chamber housing and perpendicular to a longitudinal direction of the movable contact.

3. An electromagnetic switch according to claim 1, wherein the second magnetic yokes include a suction yoke portion, which generates an electromagnetic suction force that suctions the movable plunger, and extension yoke portions coupled to the suction yoke portion and extending to back surfaces of the permanent magnets.

4. An electromagnetic switch according to claim 3, wherein the suction yoke portion includes an inner tubular portion facing a lower end side of a shaft portion of the movable plunger, a bottom plate portion covering a bottom surface of a coil bobbin, an outer tubular portion extending upward from an outer peripheral edge of the bottom plate portion and covering an outer peripheral surface of the coil bobbin, and an upper plate portion extending inward from an upper end of the outer tubular portion and covering the upper surface of the coil bobbin.

5. An electromagnetic switch according to claim 4, wherein the extension yoke portion includes extension plate portions extending from opposing outer peripheral edges of the upper plate portion of the suction yoke portion to the back surfaces of permanent magnets.

* * * * *